US007900913B2

(12) United States Patent
Katou et al.

(10) Patent No.: US 7,900,913 B2
(45) Date of Patent: Mar. 8, 2011

(54) IMAGE FORMING APPARATUS AND METHOD FOR CONTROLLING THE SAME

(75) Inventors: Hiroyo Katou, Shizuoka-ken (JP); Yoshikatsu Kamisuwa, Tokyo (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 62 days.

(21) Appl. No.: 12/406,305

(22) Filed: Mar. 18, 2009

(65) Prior Publication Data

US 2009/0236799 A1 Sep. 24, 2009

Related U.S. Application Data

(60) Provisional application No. 61/037,558, filed on Mar. 18, 2008.

(51) Int. Cl.
*B65H 7/06* (2006.01)

(52) U.S. Cl. ..... 271/227; 271/261; 271/259

(58) Field of Classification Search ..... 271/258.01, 271/259, 261, 227, 265.01, 265.02, 265.003, 271/266

See application file for complete search history.

(56) References Cited

U.S. PATENT DOCUMENTS

| | | | | |
|---|---|---|---|---|
| 4,971,304 | A * | 11/1990 | Lofthus | 271/227 |
| 5,533,721 | A * | 7/1996 | Takashimizu | 271/109 |
| 6,895,210 | B1 * | 5/2005 | Quesnel | 399/395 |
| 7,568,695 | B2 * | 8/2009 | Yasukawa et al. | 271/228 |
| 7,703,766 | B2 * | 4/2010 | Kao | 271/227 |
| 2006/0279765 | A1 * | 12/2006 | Eguchi | 358/1.14 |
| 2009/0033028 | A1 * | 2/2009 | Yahata et al. | 271/259 |
| 2009/0057992 | A1 * | 3/2009 | Katou et al. | 271/227 |
| 2009/0066016 | A1 * | 3/2009 | Kato et al. | 271/227 |
| 2009/0146370 | A1 * | 6/2009 | Kao | 271/227 |
| 2009/0224465 | A1 * | 9/2009 | Kawaguchi | 271/227 |
| 2010/0158595 | A1 * | 6/2010 | Kao | 399/395 |

FOREIGN PATENT DOCUMENTS

| | | |
|---|---|---|
| JP | 06-171796 | 6/1994 |
| JP | 09-071349 | 3/1997 |
| JP | 10-035948 | 2/1998 |
| JP | 2004-175553 | 6/2004 |
| JP | 2005-041623 | 2/2005 |
| JP | 2005-231887 | 9/2005 |
| JP | 2005-350155 | 12/2005 |
| JP | 2006-193287 | 7/2006 |
| JP | 2007-230681 | 9/2007 |

* cited by examiner

*Primary Examiner* — Kaitlin S Joerger
(74) *Attorney, Agent, or Firm* — Turocy & Watson, LLP

(57) ABSTRACT

An image forming apparatus according to the present invention includes: a first sensor that is provided in a conveying path for a sheet and detects a first passage time of the sheet; a second sensor that is provided in a position different from a position of the first sensor in both a conveying direction of the sheet and a direction orthogonal to the conveying direction, and detects a second passage time of the sheet; a skew determining unit that calculates a skew amount of the sheet from a difference between the first passage time detected by the first sensor and the second passage time detected by the second sensor and determines occurrence of skew of the sheet on the basis of the skew amount; and a cause estimating unit that estimates, when the skew determining unit determines that the skew occurs, a cause of the occurrence of the skew.

14 Claims, 12 Drawing Sheets

IMAGE FORMING APPARATUS AND METHOD FOR CONTROLLING THE SAME

CROSS-REFERENCE TO RELATED APPLICATIONS

This application is based upon and claims the benefit of priority from U.S. provisional application 61/037,558, filed on Mar. 18, 2008, the entire contents of each of which are incorporated herein by reference.

TECHNICAL FIELD

The present invention relates to an image forming apparatus and a method for controlling the same, and, more particularly to an image forming apparatus and a method for controlling the same that can prevent, when skew (oblique shift) occurs in a sheet conveyed from a paper feeding unit, occurrence of paper jam by detecting the skew and estimating a cause of the skew.

BACKGROUND

In an image forming apparatus employing an electrophotographic system such as a copying machine, a printer, or a multi-function peripheral (MFP), a toner image formed on a photoconductive drum is transferred onto a sheet to perform printing. The transfer is performed in a transfer region near the outer circumference of the photoconductive drum. The sheet before the printing is stored in a paper feeding tray or the like. During the printing, the paper is picked up from the paper feeding tray and led to the transfer region through a conveying path configured by several rollers.

While the sheet is conveyed from the paper feeding tray to the transfer region, a paper jam may occur.

In the past, when a paper jam occurs, the paper jam is detected by using plural paper detection sensors arranged on a sheet conveying path. The respective paper detection sensors detect passing timing of the leading end or the trailing end of a sheet conveyed along the sheet conveying path. When the passing timing exceeds an allowable limit value set in advance, the paper detection sensors determine that a paper jam occurs.

However, a cause of a paper jam that occurs during sheet conveyance may be present in a place other than a place where the occurrence of the paper jam is actually detected. For example, because a sheet fed by a paper feeding unit is fed in a skewed state, the sheet may be wrinkled during conveyance or, in the worst case, a paper jam may occur during the conveyance. In such a case, a real cause of the occurrence of the paper jam is not present in a place where the paper jam occurs but is present in a place where the skew of the sheet occurs. However, the image forming apparatus in the past does not have means for notifying a user of the occurrence of the paper jam and the occurrence of the skew in association with each other.

JP-A-2006-16089 discloses a technique for determining detection timing obtained from plural sheet detection sensors set in different positions in a conveying direction, storing the detection timing as a conveyance history when the detection timing exceeds a predetermined value set in advance, and narrowing down, using the conveyance history, places as causes of occurrence of a paper jam including positions other than a position where the paper jam actually occurs. However, JP-A-2006-16089 does not disclose a technique for detecting occurrence of sheet skew.

On the other hand, for example, JP-A-07-276725 discloses a technique for detecting occurrence itself of sheet skew. However, JP-A-07-276725 does not disclose a technique for associating the occurrence of the sheet skew with occurrence of a paper jam. Further, in a skew detecting method disclosed by JP-A-07-276725, it is necessary to add a separate sensor for skew detection. This leads to an increase in cost of an apparatus.

SUMMARY

The present invention is devised in view of the circumstances and it is an object of the present invention to provide an image forming apparatus and a method for controlling the same that can detect occurrence of sheet skew without, for example, addition of a special sensor, estimate a cause of the occurrence of the paper jam in association with the sheet skew, and prevent occurrence of a paper jam in advance.

In order to attain the object, according to an aspect of the present invention, there is provided an image forming apparatus including: a first sensor that is provided in a conveying path for a sheet and detects a first passage time of the sheet; a second sensor that is provided in a position different from a position of the first sensor in both a conveying direction of the sheet and a direction orthogonal to the conveying direction and detects second passage time of the sheet; a skew determining unit that calculates a skew amount of the sheet from a difference between the first passage time detected by the first sensor and the second passage time detected by the second sensor and determines occurrence of skew of the sheet on the basis of the skew amount; and a cause estimating unit that estimates, when the skew determining unit determines that the skew occurs, a cause of the occurrence of the skew.

According to another aspect of the present invention, there is provided a method for controlling an image forming apparatus including: detecting a first passage time of a sheet with a first sensor provided in a conveying path for the sheet; detecting a second passage time of the sheet with a second sensor provided in a position different from a position of the first sensor in both a conveying direction of the sheet and a direction orthogonal to the conveying direction; determining occurrence of skew of the sheet from a difference between the first passage time detected by the first sensor and the second passage time detected by the second sensor; and estimating, when it is determined that the skew occurs, a cause of the occurrence of the skew.

DETAILED DESCRIPTION

An image forming apparatus and a method for controlling the same according to an embodiment of the present invention are explained below with reference to the accompanying drawings.

(1) Configuration of the Image Forming Apparatus

Figure 1:
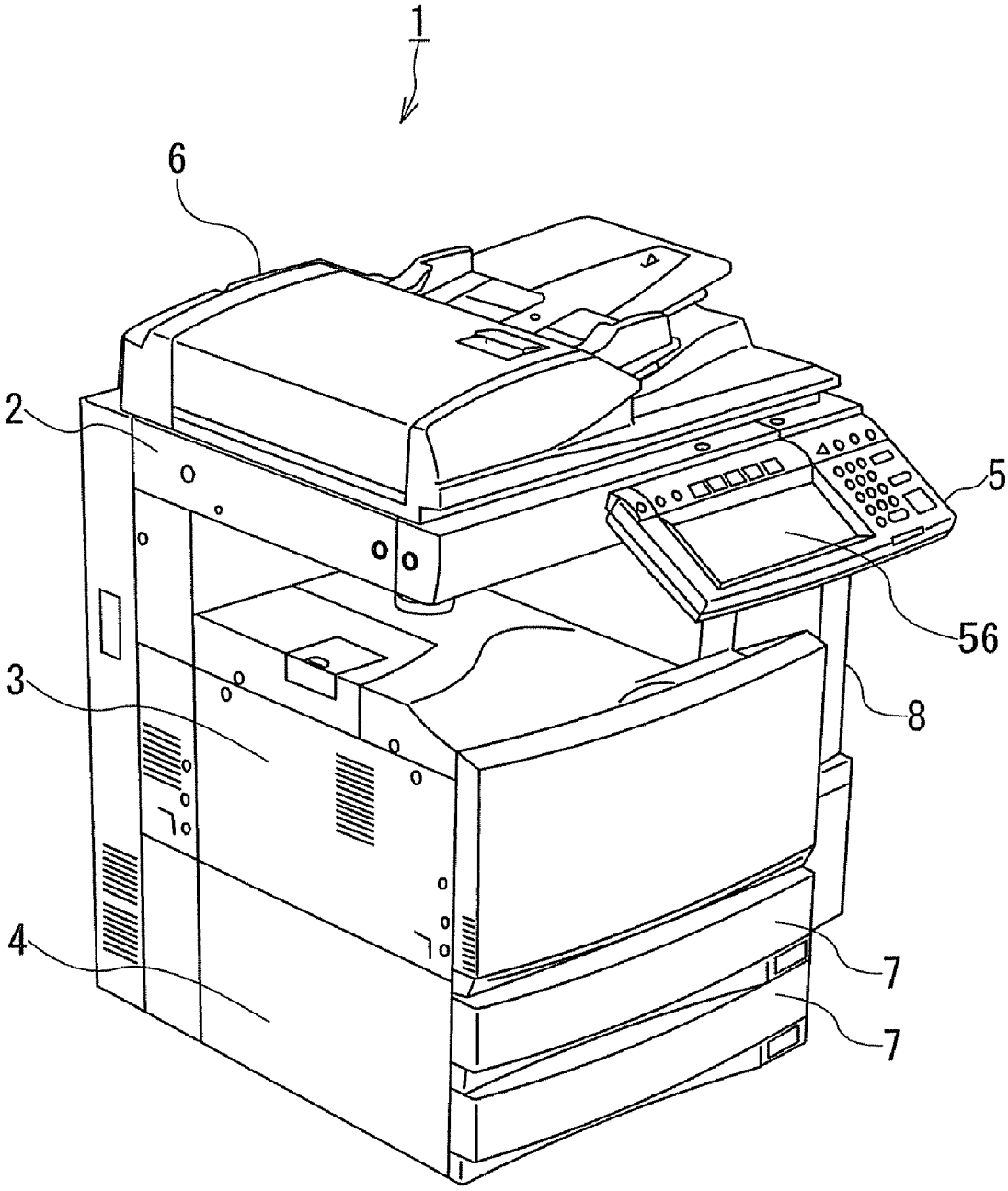
FIG. 1 is a perspective view of an external appearance example of an image forming apparatus according to an embodiment of the present invention.

FIG. 1 is a diagram of an external appearance example of a copying machine (or a multi-function peripheral (MFP)) as a typical example of an image forming apparatus 1 according to this embodiment.

The image forming apparatus 1 includes a scanning unit 2, an image forming unit 3, a paper feeding unit 4, and an operation unit 5.

The scanning unit 2 optically scans an original document placed on a document table or an original document input to an ADF (Auto Document Feeder) 6 and generates image data.

The image forming unit 3 prints the image data on a sheet fed from the paper feeding unit 4 using an electrophotographic system.

A display unit 56 and various operation buttons are provided as a user interface in the operation unit 5.

The paper feeding unit 4 includes plural (in the example in FIG. 1, two) paper feeding trays 7 that store sheets. In the following explanation, when the two paper feeding trays 7 are distinguished, the paper feeding trays 7 are referred to as paper feeding tray (1) 7 and paper feeding tray (2) 7, respectively. Any one of the paper feeding trays 7 is selected according to a designated sheet size or the like. When the sheets are exhausted, a user opens the paper feeding tray(s) 7 to set sheets and closes the paper feeding tray(s) 7.

The paper feeding unit 4 includes a manual feed tray 8 that opens to the outside of the apparatus. In performing manual feed printing, the user opens the manual feed tray 8 and places sheets on the opened manual feed tray 8.

Figure 2:
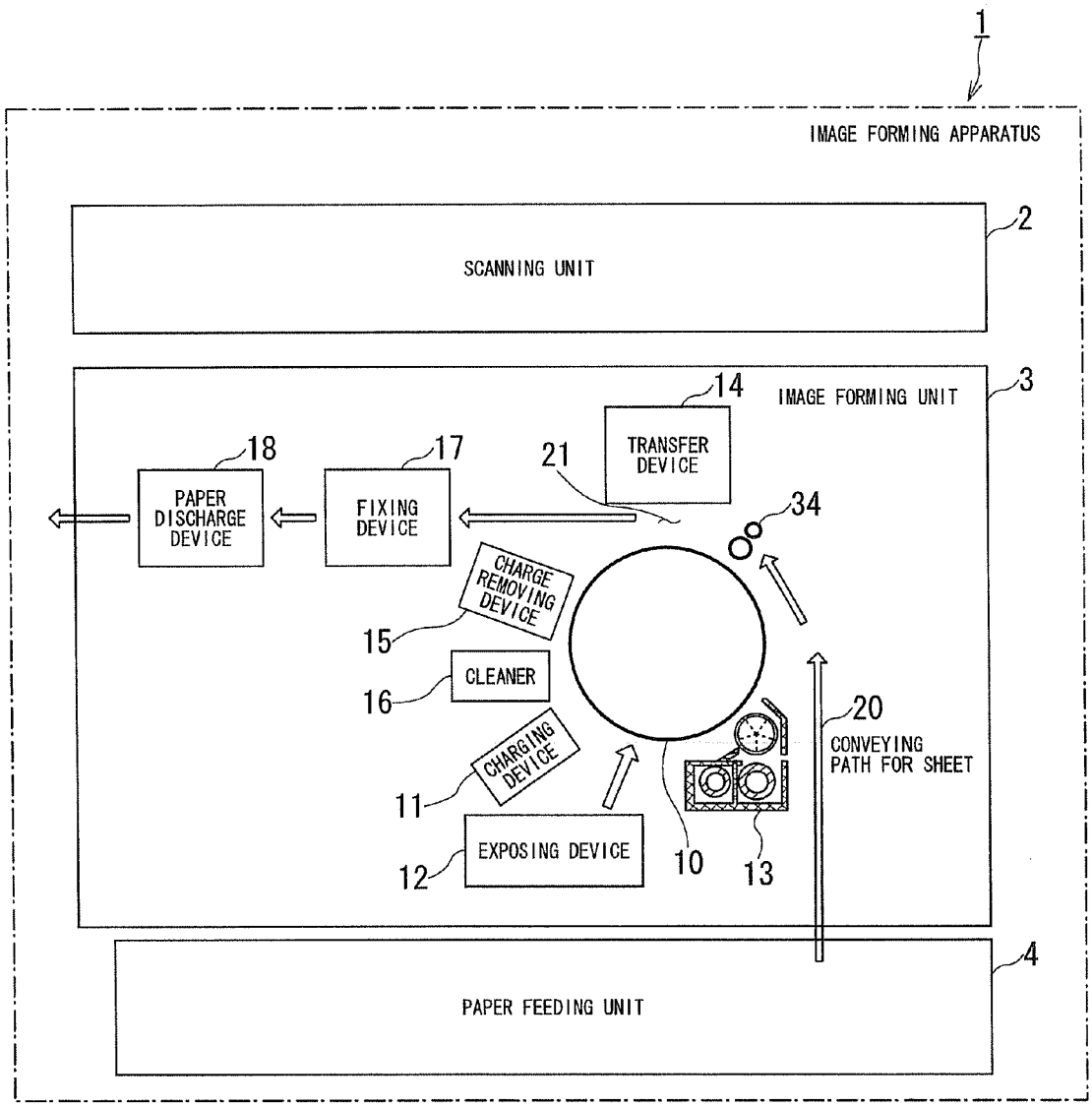
FIG. 2 is a sectional view of a configuration example of the image forming apparatus according to the embodiment.

FIG. 2 is a schematic sectional view of an internal configuration example of the image forming unit 3.

The image forming unit 3 includes, near the center thereof, a photoconductive drum 10 that rotates in an arrow direction shown in the figure. A charging device 11, an exposing device 12, a developing device 13, a transfer device 14, a charge removing device 15, and a cleaner 16 are disposed around the photoconductive drum 10 in order from upstream to downstream of the rotation.

The charging device 11 uniformly charges the surface of the photoconductive drum 10 to a predetermined potential. The exposing device 12 irradiates a laser beam modulated according to the intensity of image data on the surface of the photoconductive drum 10. When the laser beam is irradiated, the potential in a part on which the laser beam is irradiated falls. An electrostatic latent image is formed on the surface of the photoconductive drum 10.

The developing device 13 deposits a developer on the surface of the photoconductive drum 10 to develop the electrostatic latent image. The developing device 13 develops the electrostatic latent image with a toner in the developer and forms a toner image on the surface of the photoconductive drum 10.

Meanwhile, a sheet is conveyed from the paper feeding tray 7 of the paper feeding unit 4 to a transfer region 21 (a position where the photoconductive drum 10 and the transfer device 14 are opposed to each other). The transfer device 14 transfers the toner image on the photoconductive drum 10 onto the sheet.

Registration rollers 34 are provided immediately before the transfer region 21. Skew of the sheet that occurs in a conveyance path (a conveying path 20) leading from the paper feeding unit 4 to the registration rollers 34 is corrected by the registration rollers 34.

However, when a skew angle is too large, the registration rollers 34 cannot completely correct the skew angle. A paper jam may occur because of occurrence of skew. Therefore, the image forming apparatus 1 according to this embodiment performs processing for, for example, detecting occurrence of skew and, when a skew angle is equal to or larger than a predetermined reference value, displaying warning to a user or stopping conveyance of a sheet. Occurrence of a paper jam can be prevented by this processing. Even when a paper jam occurs, the image forming apparatus 1 performs processing for displaying, as an estimated cause of the occurrence of the paper jam, for example, presence or absence of occurrence of skew and a place estimated as a cause of the occurrence of the skew. Details of these kinds of processing are explained later.

The sheet having the toner image transferred thereon is conveyed to a fixing device 17 provided on a downstream side of the transfer device 14. The sheet is heated and pressed and the toner image is fixed on the sheet. The sheet subjected to fixing processing is discharged to the outside by a paper discharge device 18.

In the photoconductive drum 10 from which the transfer of the toner image onto the sheet is finished, surface charges are removed by the charge removing device 15 and the toner remaining on the surface is removed by the cleaner 16.

It is possible to perform continuous printing by repeating the processing explained above.

Figure 3:
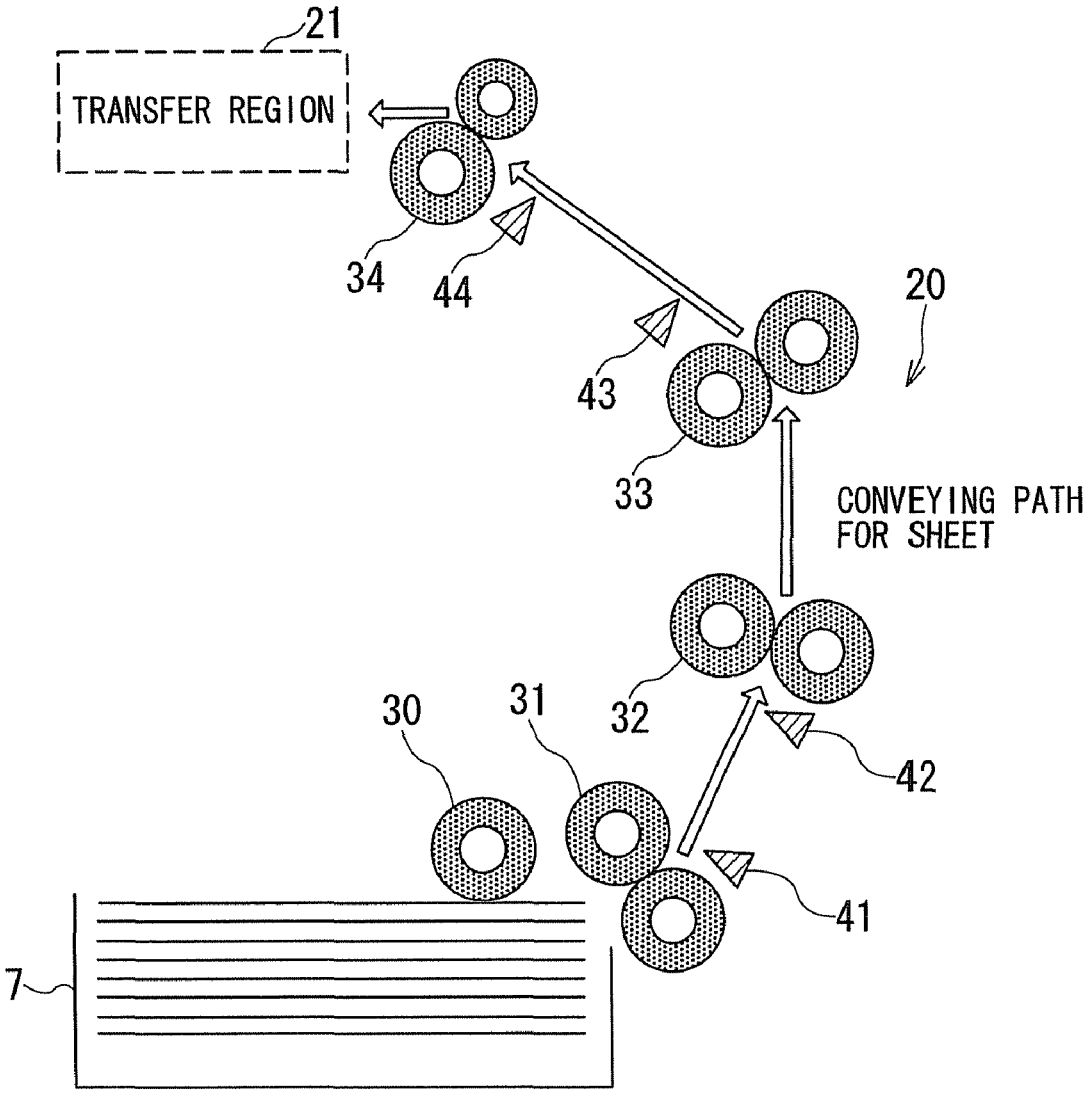
FIG. 3 is a side view of a configuration example and an arrangement example of rollers and sensors provided in a conveying path for a sheet.

FIG. 3 is a schematic diagram of a configuration example of the conveying path 20 of the image forming apparatus 1 according to this embodiment. A sheet before printing is stored in the paper feeding tray 7 provided in the paper feeding unit 4. In the conveying path 20 leading from the paper feeding tray 7 to the transfer region 21, a pickup roller 30, paper feeding rollers (first rollers) 31, conveying rollers (1) (second rollers) 32, conveying rollers (2) (third rollers) 33, the registration rollers 34, and the like are provided in order from the paper feeding tray side.

When printing is instructed from the operation unit 5, the sheet is picked up from the paper feeding tray 7 by the pickup roller 30 and thereafter conveyed by the paper feeding rollers 31, the conveying rollers (1) 32, and the conveying rollers (2) 33 to reach the position of the registration rollers 34.

The rotation of the registration rollers 34 is stopped at a point when the printing is instructed. A leading end of the sheet conveyed from the conveying path 20 bumps into a nip portion of the stopped registration rollers 34. When a skew occurs in the sheet, one end of a leading end line of the sheet bumps against the nip portion earlier than the other end of the leading end line. Thereafter, sheets are continuously fed from the conveying path 20 by the rotation of the conveying rollers (1) 32 and the conveying rollers (2) 33. Therefore, deflection occurs near the end of the sheet that bumps into the nip portion earlier. The other end of the leading end line soon reaches the nip portion and the leading end line of the sheet is aligned with and becomes parallel to a line of the nip portion. Misalignment of the leading end line of the sheet is absorbed by the deflection that occurs near the end of the sheet and the skew is corrected. When it is determined that the skew is corrected and the leading end line of the sheet becomes parallel to the line of the nip portion (i.e., the correction of the skew is completed), the registration rollers 34 start rotation and convey the leading end line of the sheet to the transfer region.

The completion of the skew correction is determined according to, for example, whether a predetermined period (a skew correction period) elapses after the leading end of the sheet comes into contact with the nip portion of the registration rollers 34. More specifically, a registration sensor 44 arranged in a position immediately before the registration rollers 34 detects passage of the leading end of the sheet and thereafter, when the set skew correction period elapses, the completion of the skew correction is determined. Then, the registration rollers 34 start rotation and draws the leading end of the sheet into the transfer region.

In the conveying path 20 for the sheet, besides the registration sensor 44, a paper feed sensor (a first sensor) 41 is provided near the paper feeding rollers 31, a conveyance sensor (1) (a second sensor) 42 is provided near the conveying rollers (1) 32, and a conveyance sensor (2) (a third sensor) 43 is provided near the conveying rollers (2) 33.

The passage of the sheet through the conveying path 20 is detected by using these four sensors. Each of the sensors includes, for example, a photosensor. When the leading end of the sheet is detected, each of the sensors is turned on and detects time of the turn-on as ON time. On the other hand, when the trailing end of the sheet passes the sensor, the sensor is turned off and detects time of the turn-off as OFF time. It is possible to determine a passing state of the sheet on the basis of ON times and OFF times detected by the sensors. When a paper jam occurs in the conveying path 20, it is possible to specify not only presence or absence of the occurrence of the paper jam but also a position where the paper jam occurs.

Other than the conveying path 20 leading from the paper feeding tray 7 to the registration rollers 34, a paper jam could also occur. Therefore, sensors similar to the above are also arranged in a conveying path further downstream than the registration rollers 34. These sensors detect presence or absence of the occurrence of the paper jam and an occurrence position of the paper jam.

One of main causes of occurrence of a paper jam is skew of the sheet. In the image forming apparatus 1 according to this embodiment, the arrangement of the sensors on the conveying path 20 is contrived. The sensors are used not only for detection of a paper jam but also for detection of skew.

Figure 4:
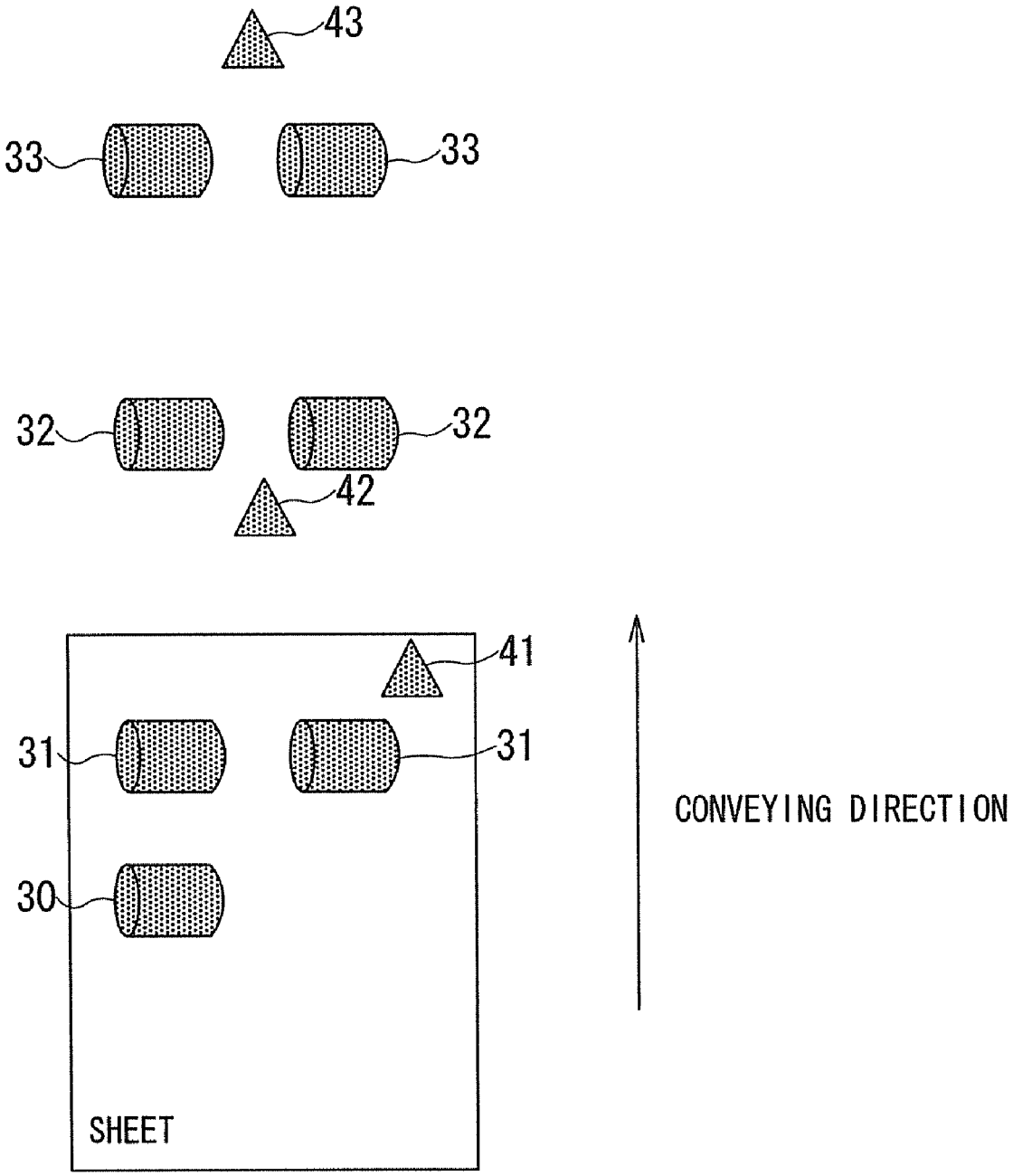
FIG. 4 is a plan view of a configuration example and an arrangement example of the rollers and the sensors provided in the conveying path for a sheet.

FIG. 4 is a diagram of a state of the arrangement of the paper feed sensor 41, the conveyance sensor (1) 42, and the conveyance sensor (2) 43 used for skew detection. In the figure, the state of the arrangement is two-dimensionally expanded in a conveying direction of the sheet and a direction orthogonal to the conveying direction.

As it is seen from FIG. 4, the paper feed sensor (the first sensor) 41 is set near the paper feeding rollers 31 and in a position away from the center of the two paper feeding rollers 31. The conveyance sensor (1) (the second sensor) 42 is arranged in a position different from the position of the paper feed sensor 41 in the conveying direction of the sheet and in the direction orthogonal to the conveying direction. In other words, the paper feed sensor 41 and the conveyance sensor (1) 42 are arranged obliquely to the conveying direction of the sheet.

On the other hand, the conveyance sensor (2) (the third sensor) 43 is arranged in a position different from the position of the conveyance sensor (1) 42 in the conveying direction of the sheet but same as the position of the conveyance sensor (1) 42 in the direction orthogonal to the conveying direction. In other words, the conveyance sensor (2) 43 and the conveyance sensor (1) 42 are arranged parallel to the conveying direction of the sheet.

(2) Skew Detecting Method

A method for controlling the image forming apparatus 1 configured as explained above, in particular, a skew detecting method for a sheet is explained below.

Figure 5:
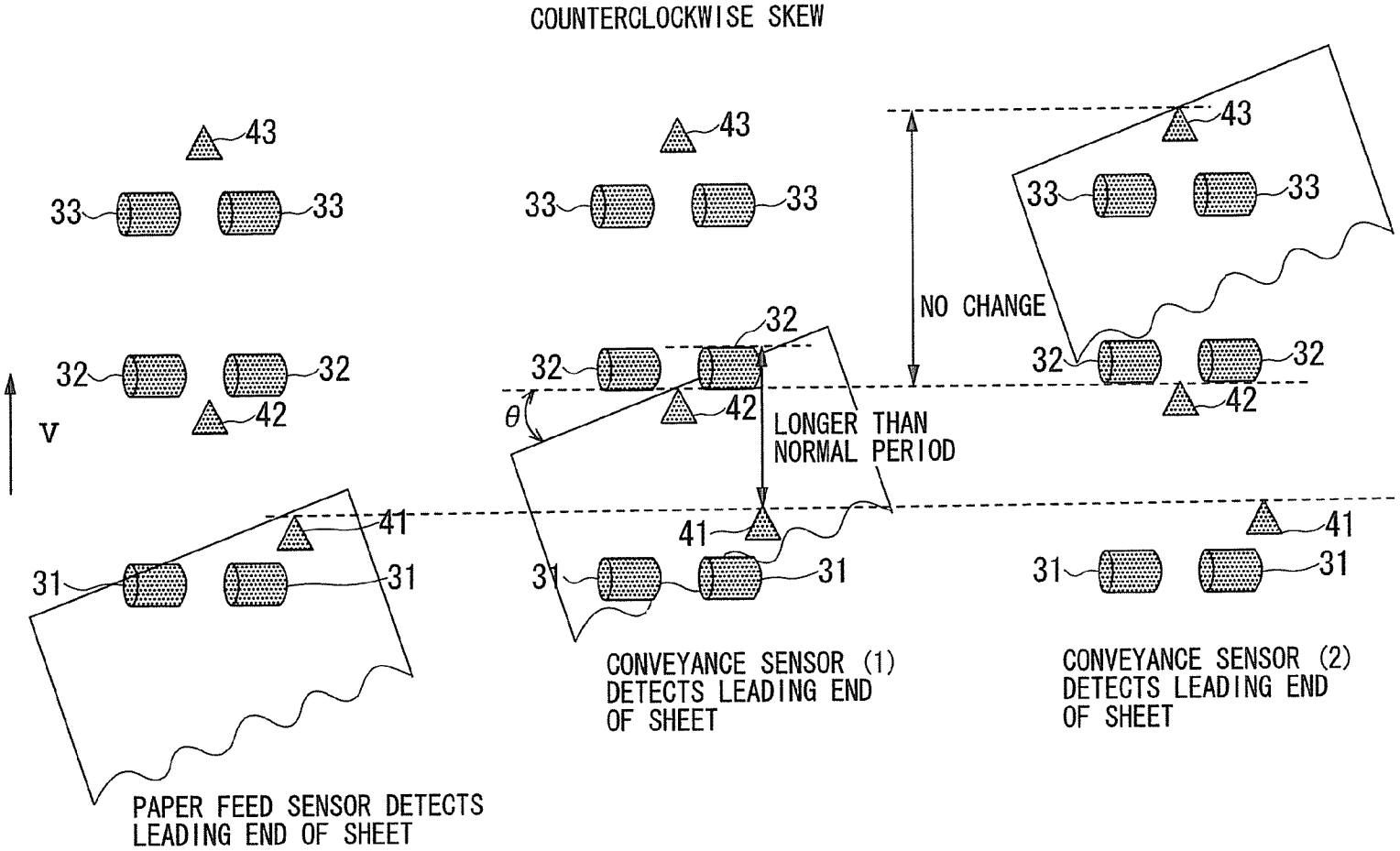
FIG. 5 is a first diagram (counterclockwise skew) for explaining an operation principle of skew amount detection according to the embodiment.
Figure 6:
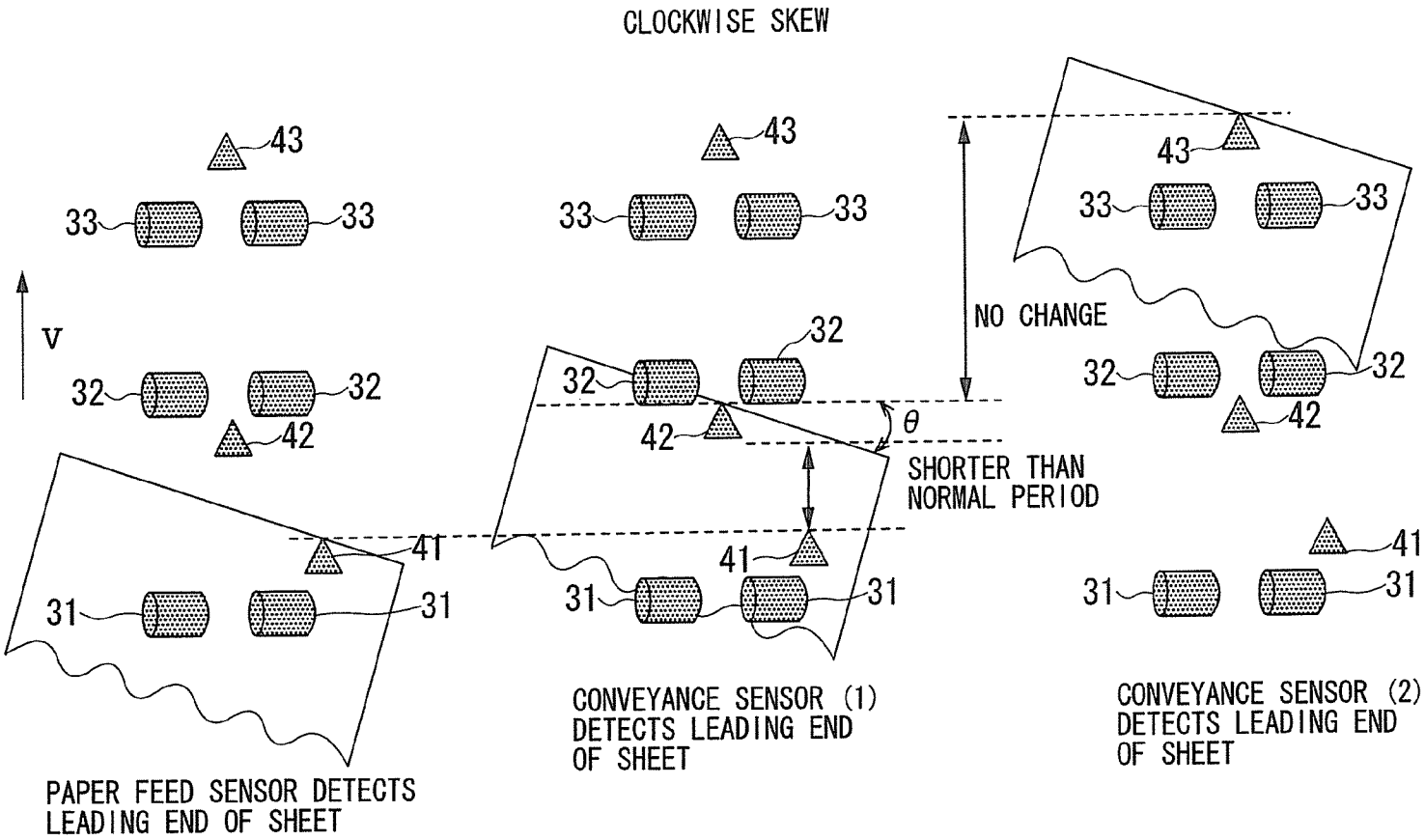
FIG. 6 is a second diagram (clockwise skew) for explaining the operation principle of the skew amount detection according to the embodiment.

FIGS. 5 and 6 are diagrams for explaining a principle of the skew detecting method according to this embodiment. FIG. 5 is a diagram of a state in which counterclockwise skew occurs. FIG. 6 is a diagram of a state in which clockwise skew occurs.

A figure on the left side in FIG. 5 is a diagram of a state in which the leading end of the sheet passes the position of the paper feed sensor 41 in a state skewed counterclockwise. A figure in the center in FIG. 5 is a diagram of a state in which the sheet is further conveyed and the leading end of the sheet passes the position of the conveyance sensor (1) 42. A figure on the right side in FIG. 5 is a diagram of a state in which the sheet is thereafter further conveyed and the leading end of the sheet passes the position of the conveyance sensor (2) 43.

As explained above, the conveyance sensor (1) 42 and the conveyance sensor (2) 43 are arranged parallel to the conveying direction of the sheet. Therefore, a period in which the sheet passes the two sensors indicates the same value in a normal state in which the sheet is not skewed and a state in which the sheet is skewed.

On the other hand, the paper feed sensor 41 and the conveyance sensor (1) 42 are arranged obliquely to the conveying direction of the sheet. Therefore, a period in which the sheet passes the two sensors is different in the normal state in which the sheet is not skewed and the state in which the sheet is skewed. As shown in FIG. 5, a period T in which the leading end of the sheet passes between the paper feed sensor 41 and the conveyance sensor (1) 42 when the sheet is skewed counterclockwise is longer than a period T0 in which the leading end of the sheet passes between the paper feed sensor 41 and the conveyance sensor (1) 42 when the sheet is not skewed ($T>T0$).

Similarly, as shown in FIG. 6, when the sheet is skewed clockwise, the period T in which the leading end of the sheet passes between the paper feed sensor 41 and the conveyance sensor (1) 42 is also different from the passage period T0 in the normal state in which the sheet is not skewed. However, in this case, the passage period T when the sheet is skewed is shorter than the passage period T0 ($T<T0$) when the sheet is not skewed.

A skew amount s of the sheet is represented by a skew angle θ (see drawings in the centers of FIGS. 5 and 6). A distance in the direction orthogonal to the conveying direction between the paper feed sensor 41 and the conveyance sensor (1) 42 is represented as L and conveying speed for the sheet is represented as V0. Then, the skew angle θ is represented by the following formula.

$$\tan(\theta)=ABS(T-T0)\cdot(V0/L) \quad \text{Formula 1}$$

where ABS( ) is an operator for calculating an absolute value. The normal passage period T0 in which the sheet is not skewed, the conveying speed V0 for the sheet, and the distance L are values given in advance.

The passage period T in Formula 1 is a period calculated from a difference between time when the leading end of the sheet passes the paper feed sensor 41 (first passage time t1) and time when the leading end of the sheet passes the conveyance sensor (1) 42 (second passage time t2) (T=t2−t1). The skew angle θ can be calculated from Formula 1 on the basis of the period T and the passage period T0, the conveying speed V0, and the distance L.

The conveying speed V0 for the sheet used in Formula 1 is normal conveying speed in which abrasion or the like does not occur in the rollers. Therefore, if abrasion or the like occurs in the rollers and actual conveying speed V substantially deviates from the normal conveying speed V0, it is likely that an error occurs when a skew angle is calculated by using Formula 1.

Therefore, in this embodiment, whether the actual conveying speed V substantially deviates from the normal conveying speed V0 is determined from the time when the leading end of the sheet passes the conveyance sensor (1) 42 (the second passage time t2), and passage time of the conveying sensor (2) 43 arranged in parallel in the conveying direction with respect to the conveyance sensor (1) 42 (a third passage time t3).

Figure 7:
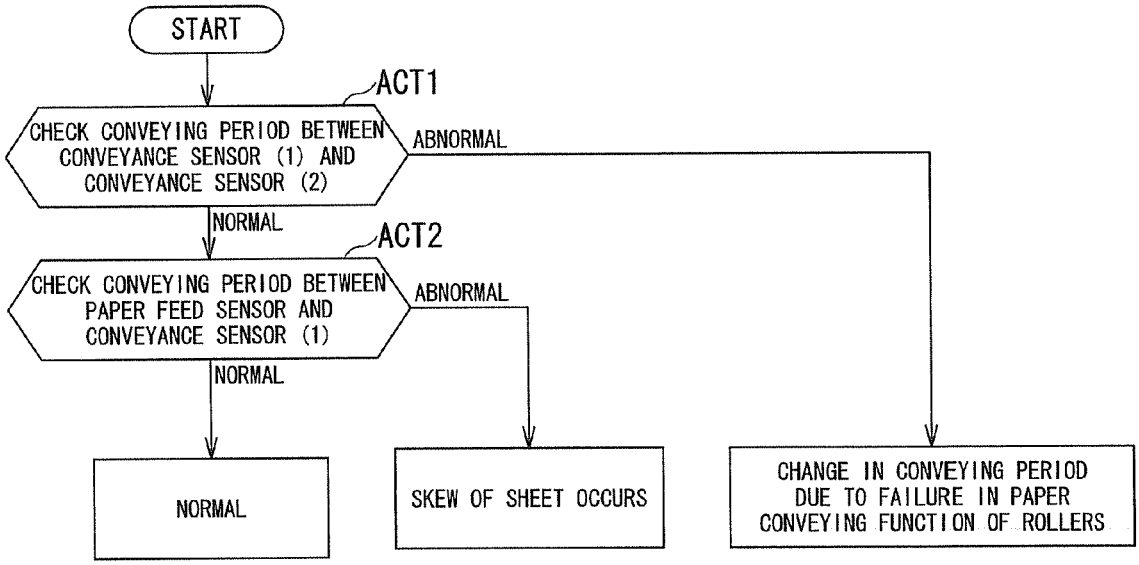
FIG. 7 is a flowchart of an example of processing necessary for determining occurrence of skew.

FIG. 7 is a flowchart of an example of the determination processing. In ACT 1, conveying period of the sheet (or conveying speed of the sheet) between the conveyance sensor (1) 42 and the conveyance sensor (2) 43 is calculated from the passage time t2 when the leading end of the sheet passes the conveyance sensor (1) 42 and the passage time t3 when the leading end of the sheet passes the conveyance sensor (2) 43. The conveying period is compared with a normal conveying period. If the difference in the conveying period (or the conveying speed) is not within a predetermined reference range, it is determined that the conveying period (or the conveying speed) is abnormal. In this case, it is assumed that some failure occurs in a sheet conveying function of the rollers because of abrasion or the like of the rollers.

If there is no abnormality in the conveying period of the sheet (or the conveying speed of the sheet) between the conveyance sensor (2) 43 and the conveyance sensor (1) 42, the processing proceeds to skew determination processing in ACT 2. In ACT 2, conveying period between the paper feed sensor 41 and the conveyance sensor (1) 42 is checked. If the conveying period is within a predetermined range, it is determined that skew does not occur (normal). If the conveying period is outside the predetermined range, it is determined that skew occurs (abnormal). In ACT 2, the skew angle θ may be calculated on the basis of Formula 1 and normality or abnormality may be determined with respect to the skew angle θ.

In the above explanation, the sensors detect passage times of the leading end of the sheet. However, instead, the trailing end of the sheet may be detected.

The arrangement of the paper feed sensor 41, the conveyance sensor (1) 42, and the conveyance sensor (2) 43 is not limited to the arrangement shown in FIG. 4 (or FIGS. 5 and 6).

Figure 8:
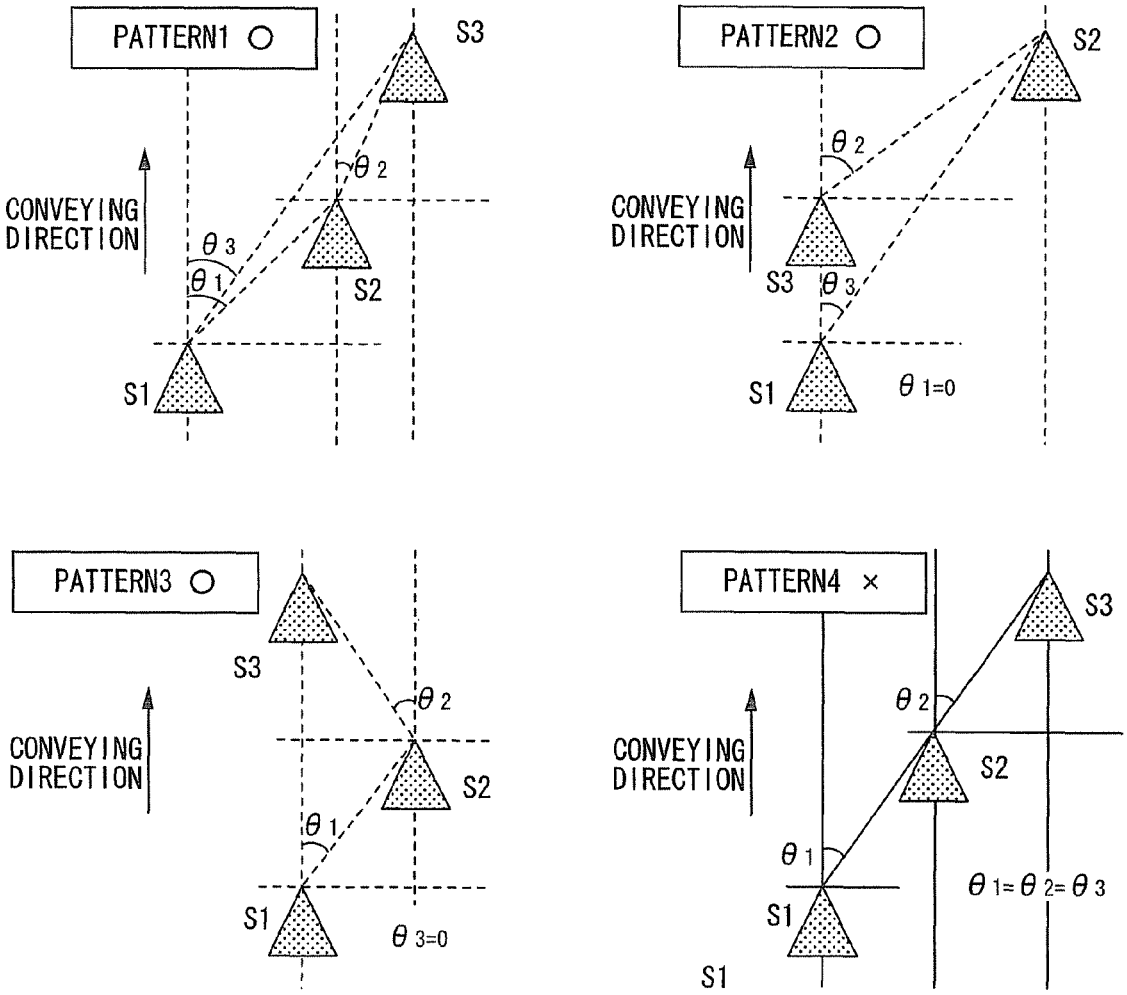
FIG. 8 is a diagram of sensor arrangement examples that can be applied to the image forming apparatus according to the embodiment and a sensor arrangement example that cannot be applied to the image forming apparatus.

FIG. 8 is a diagram of arrangement examples that can be applied to the image forming apparatus 1 according to this embodiment (a pattern 1, a pattern 2, and a pattern 3) and an arrangement example that cannot be applied to the image forming apparatus 1 (a pattern 4). Two sensors are necessary to detect a skew angle. The two sensors are a first sensor S1 and a second sensor S2. To separately detect a change in conveying speed of the sheet and skew, one more sensor (a third sensor S3) is necessary.

The first sensor S1 and the second sensor S2 for detecting a skew angle need to be arranged in different positions in both the conveying direction of the sheet and the direction orthogonal to the conveying direction. In the arrangement example shown in FIG. 4 (or FIGS. 5 and 6), the first sensor S1 and the second sensor S2 corresponds to the paper feed sensor 41 and the conveyance sensor (1) 42, respectively.

On the other hand, the third sensor S3 can be freely arranged as illustrated by the pattern 1, the pattern 2, and the pattern 3 unless the third sensor S3 is arranged on a straight line connecting the first sensor S1 and the second sensor S2 as illustrated by the pattern 4. In the arrangement example shown in FIG. 4 (or FIGS. 5 and 6), the third sensor S3 corresponds to the conveyance sensor (2) 43.

Figure 9:
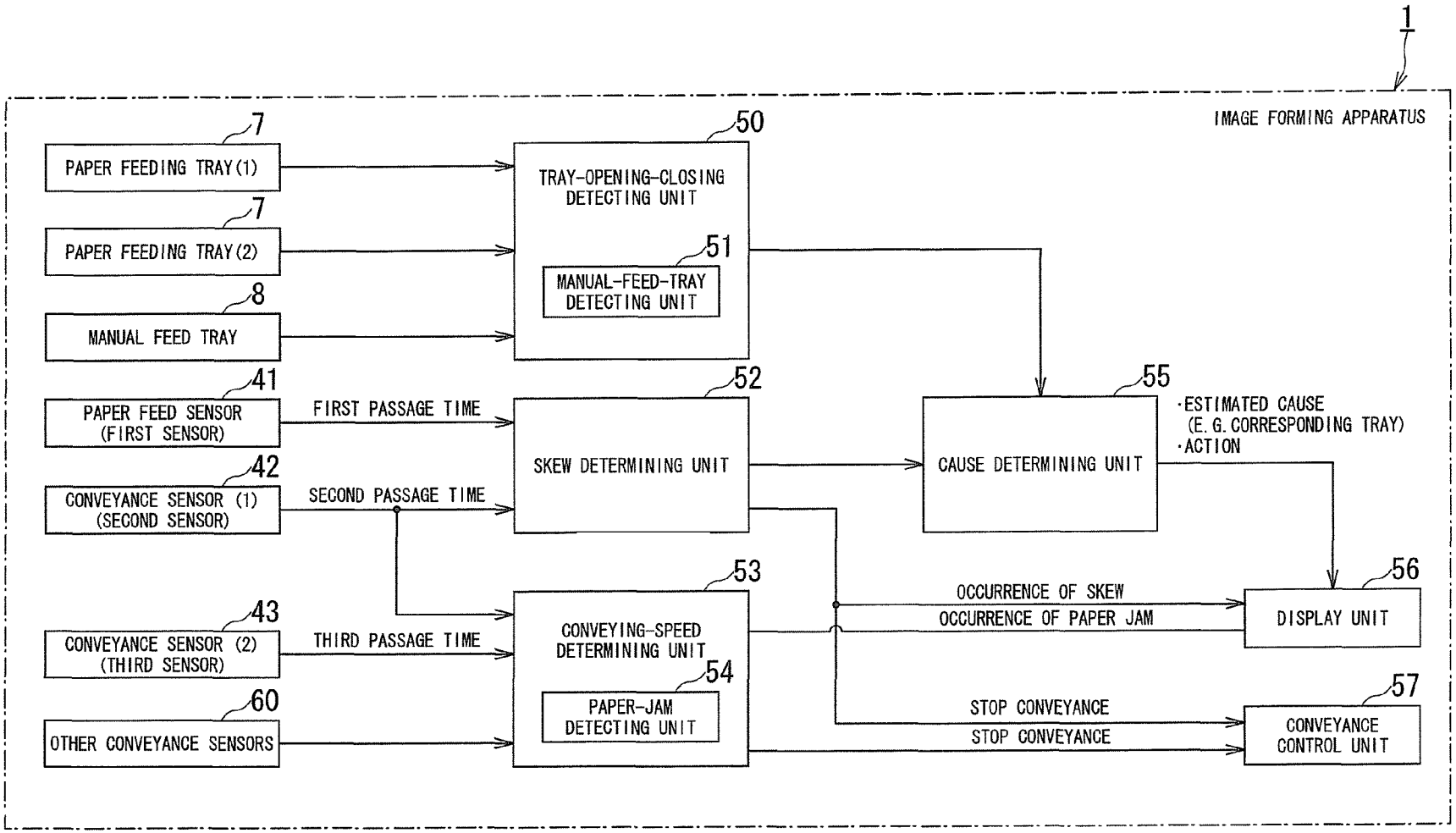
FIG. 9 is a functional block diagram of, in particular, functions related to skew detection, paper jam detection, and estimation of causes of the skew and the paper jam among functions of the image forming apparatus according to the embodiment.

(3) Configuration of the Image Forming Apparatus and a Method of Controlling the Same FIG. 9 is a functional block diagram of, in particular, functions related to skew detection, paper jam detection, and estimation of causes of the skew and the paper jam among functions of the image forming apparatus 1 according to this embodiment. In order to realize these functions, the image forming apparatus 1 includes, besides the paper feed sensor 41, the conveyance sensor (1) 42, and the conveyance sensor (2) 43, a skew determining unit 52, a conveying-speed determining unit 53, a paper-jam detecting unit 54, a cause determining unit 55, a display unit 56, and a conveyance control unit 57.

The image forming apparatus 1 further includes a tray-opening-closing detecting unit 50 and a manual-feed-tray detecting unit 51.

Among the functional blocks, the skew determining unit 52 calculates the skew amount s of the sheet from a difference between the first passage time t1 detected by the paper feed sensor 41 (the first sensor) and the second passage time t2 detected by the conveyance sensor (1) 42 (the second sensor) and determines occurrence of skew of the sheet on the basis of the skew amount s. Specifically, for example, the skew determining unit 52 calculates the skew amounts (the skew angle θ) according to Formula 1, compares the calculated skew amount s with predetermined thresholds Smax1 and Smax2 to determine occurrence of skew.

The conveying-speed determining unit 53 calculates the conveying speed V of the sheet according to the third passage time t3 detected by the conveyance sensor (2) 43 (the third sensor) and the second passage time t2 detected by the conveyance sensor (1) 42. When a distance between the conveyance sensor (2) 43 and the conveyance sensor (1) 42 is represented as $D_{2\text{-}3}$, the conveying speed of the sheet can be calculated from, for example, $V=D_{2\text{-}3}/(t3-t2)$.

If the calculated conveying speed V of the sheet is within a predetermined range, the skew determining unit 52 performs skew determination. If the conveying speed V is outside the predetermined range, the skew determining unit 52 determines that some failure occurs in the sheet conveying function itself because of abrasion or the like of the rollers. In this case, the skew determining unit 52 causes the display unit 56 to display an alarm or instructs the conveyance control unit 57 to stop the conveyance of the sheet.

The paper-jam detecting unit 54 detects occurrence of a paper jam from passage time information of conveyance sensors 60 of the respective units in addition to the three sensors. When a paper jam occurs, the paper-jam detecting unit 54 instructs the conveyance control unit 57 to stop the conveyance and sends information for displaying the occurrence of the paper jam and an occurrence position of the paper jam to the display unit 56.

The occurrence of the paper jam is often caused by skew of the sheet. Empirically, the skew of the sheet often occurs when sheets are supplied to the paper feeding tray 7 anew. Skew tends to occur when the sheets are not properly set in the paper feeding tray 7 or a sheet guide in the paper feeding tray 7 is not properly set.

Therefore, the tray-opening-closing detecting unit 50 detects that the paper feeding tray 7 is once opened and then closed to thereby determine whether sheets are supplied to the paper feeding tray 7 anew. When there are plural paper feeding trays 7 as in this embodiment, the tray-opening-closing detecting unit 50 can specify which of the paper feeding trays 7 is opened and then closed.

When manual feed printing is performed, skew may occur unless a setting condition of sheets placed on the manual feed tray 8, such as a sheet direction or a setting condition of a sheet guide, is not proper. Therefore, the manual-feed-tray detecting unit 51 detects whether printing is performed by using the manual feed tray 8.

If the skew determining unit 52 determines that skew occurs, the cause determining unit 55 estimates a cause of the occurrence of the skew. Specifically, when skew occurs after the paper feeding tray 7 is opened and then closed, the cause determining unit 55 estimates that the skew occurs because of the opened and then closed paper feeding tray and causes the display unit 56 to perform display to urge the user to check whether the sheets or the sheet guide in the paper feeding tray 7 is properly set. When skew occurs during the use of the manual feed tray 8, the cause determining unit 55 estimates that the skew occurs because of the manual feed tray 8 and causes the display unit 56 to perform display to call attention of the user to a setting condition of the manually fed sheets, such as a sheet direction or a setting condition of a sheet guide.

The display unit 56 is a display device provided in the operation unit 5 and includes, for example, a liquid crystal panel.

The conveyance control unit 57 controls ON, OFF, and the like of a conveyance motor (not shown) that drives various conveying rollers.

Figure 10:
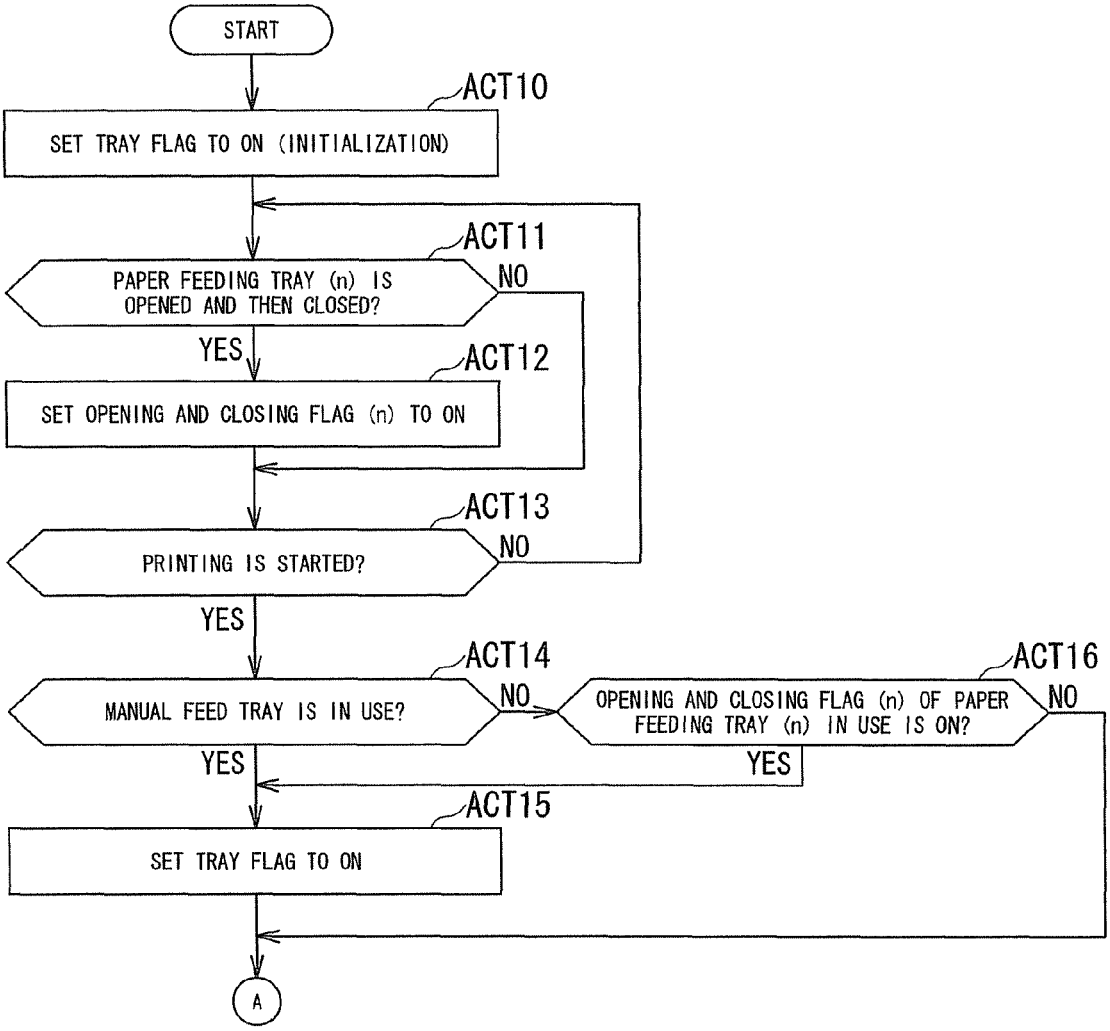
FIG. 10 is a flowchart of a processing example related to tray opening and closing detection.
Figure 11:
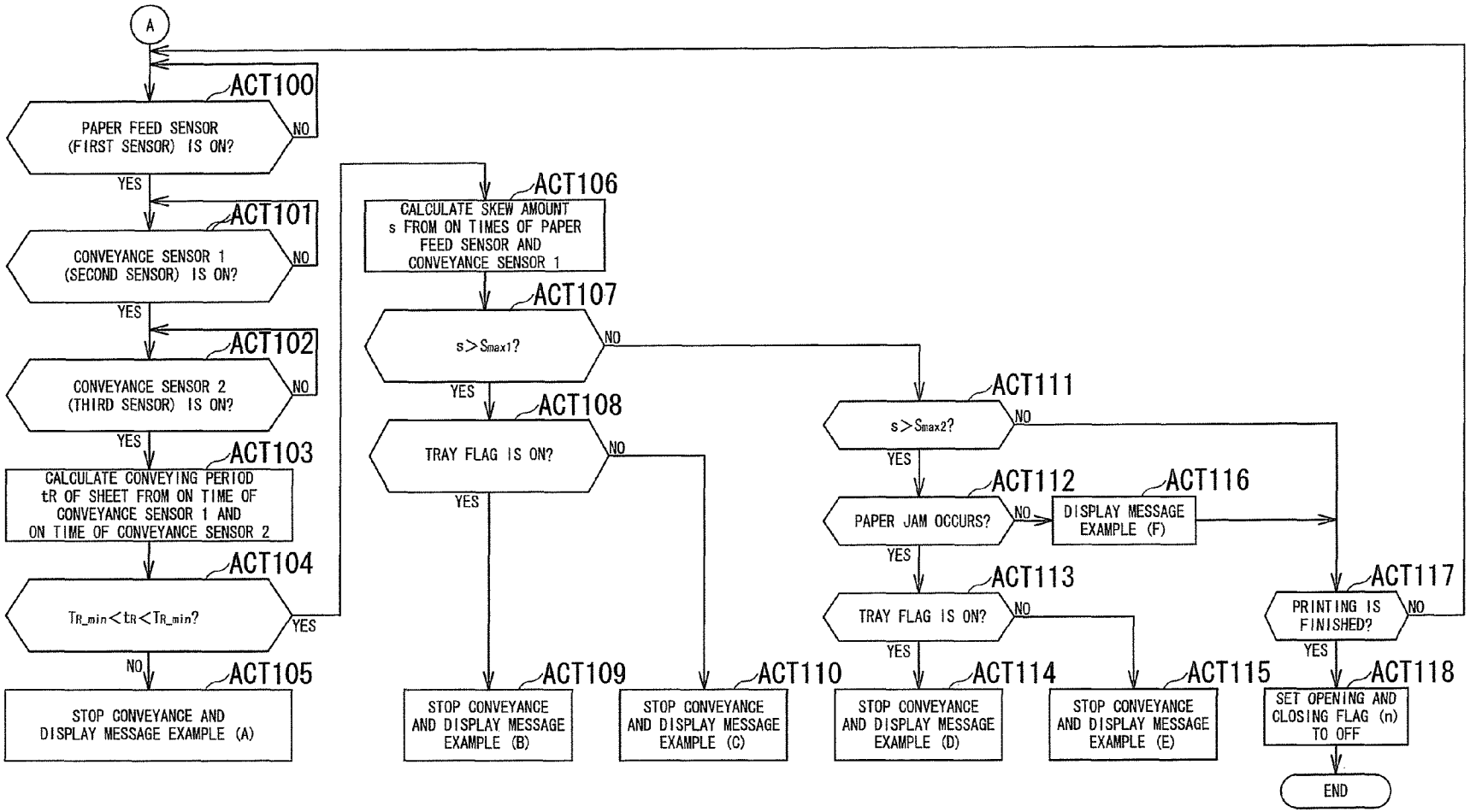
FIG. 11 is a flowchart of a processing example mainly related to skew determination, conveying speed determination, cause determination, display, and conveyance control.

FIGS. 10 and 11 are flowcharts of more specific processing examples of the functional blocks explained above. FIG. 10 is a diagram of a processing example related to the tray-opening-closing detecting unit 50 (and the manual-feed-tray detecting unit 51).

In ACT 10 in FIG. 10, the tray-opening-closing detecting unit 50 sets a tray flag to OFF for initialization. In ACT 20, the tray-opening-closing detecting unit 50 determines whether the paper feeding tray (n) 7 is opened and then closed. "n" is a reference number for identifying the respective paper feeding trays 7 when there are the plural paper feeding trays 7. In the image forming apparatus 1 according to this embodiment shown in FIG. 1, the two paper feeding trays (1) and (2) are provided. Therefore, in ACT 11, the tray-opening-closing detecting unit 50 specifies which of the paper feeding trays is opened and then closed.

In ACT 12, the tray-opening-closing detecting unit 50 sets an opening and closing flag (n) corresponding to the opened and then closed paper feeding tray (n) to ON and waits for the start of printing (ACT 13). The opening and closing flag (n) is provided to correspond to each of the plural paper feeding trays (n).

If the paper feeding tray 7 is not opened and then closed, the tray-opening-closing detecting unit 50 proceeds to ACT 13 without setting the opening and closing flag (n) to ON and waits for the start of printing.

When printing is started, in ACT 14, the tray-opening-closing detecting unit 50 determines whether the manual feed tray 8 is in use. If the manual feed tray 8 is used to perform printing, the tray-opening-closing detecting unit 50 sets the tray flag to ON (ACT 15) and proceeds to processing shown in FIG. 11.

If the manual feed tray 8 is not used to perform printing, the printing is performed by using any one of the paper feed trays 7. In this case, the tray-opening-closing detecting unit 50 refers to the opening and closing flag (n) corresponding to the paper feeding tray (n) in use. If the opening and closing flag (n) is ON (YES in ACT 16), the tray-opening-closing detecting unit 50 sets the tray flag to ON and proceeds to the processing shown in FIG. 11.

On the other hand, if the opening and closing flag (n) corresponding to the paper feeding tray (n) in use is not ON, the tray-opening-closing detecting unit 50 proceeds to the processing shown in FIG. 11 without setting the tray flag to ON.

As explained above, the tray flag is set to ON when the paper feed tray 7 presently used for printing is opened and then closed before the start of printing (i.e., when sheets are supplied to the paper feeding tray anew) or when the manual feed tray 8 is presently used to perform printing.

On the other hand, even when one paper feeding tray 7 is opened and then closed to feed sheets before the start of printing, if another paper feeding tray 7 is selected to perform printing, the tray flag is not set to ON.

FIG. 11 is a flowchart of a processing example of mainly the skew determining unit 52, the conveying-speed determining unit 53 (including the paper-jam detecting unit 54), the cause determining unit 55, the display unit 56, and the conveyance control unit 57 among the functional blocks shown in FIG. 9.

In ACT 100, the conveying-speed determining unit 53 waits for the paper feed sensor 41 (the first sensor) to be turned on and, when the paper feed sensor 41 (the first sensor) is turned on, stores ON time t1 thereof (first passage time) in an appropriate memory.

In ACT 101, the conveying-speed determining unit 53 waits for the conveyance sensor (1) 42 (the second sensor) to be turned on and, when the conveyance sensor (1) is turned on, stores ON time t2 thereof (second passage time) in an appropriate memory.

In ACT 102, the conveying-speed determining unit 53 waits for the conveyance sensor (2) 43 (the third sensor) to be turned on and, when the conveyance sensor (2) is turned on, stores ON time t3 thereof (third passage time) in an appropriate memory.

In ACT 103, the conveying-speed determining unit 53 calculates, from a difference between the ON time t3 detected by the conveyance sensor (2) 43 and the ON time t2 detected by the conveyance sensor (1) 42, a period $t_R$ in which the sheet is conveyed from the conveyance sensor (1) 42 to the conveyance sensor (2) 43 ($t_R$=t3−t2).

In ACT 104, the conveying-speed determining unit 53 determines whether the conveyance period $t_R$ calculated in ACT 103 is within a predetermined range (a range from a minimum value $T_{R_min}$ to a maximum value $T_{R_max}$) ($T_{R_min}<t_R<T_{R_max}$).

If it is determined in ACT 104 that the conveyance period $t_R$ is not within the predetermined range, it is estimated that the conveying speed V0 of the sheet is not normal because of a cause such as abrasion that occurs in the rollers.

Therefore, in this case, a correct skew amount is not obtained even if skew amount determination based on the conveying speed V0 is performed. Therefore, processing for the skew amount determination (processing in ACT 106, ACT 107, ACT 111, and the like) is not performed.

In this case, a paper jam is considered to occur in the conveying path 20. Therefore, the conveying-speed determining unit 53 may instruct the display unit 56 to display a message (A) that "paper jam occurs" (ACT 105).

Figure 12A:
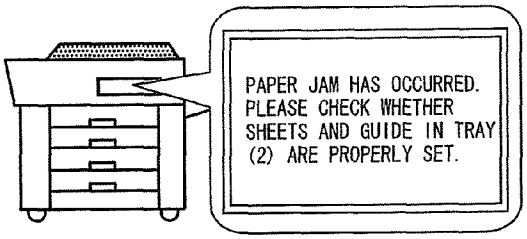
FIGS. 12A to 12F are diagrams of message display examples on a display unit.

FIGS. 12A to 12F are diagrams of display examples of the display unit 56. In ACT 105, for example, a message shown in FIG. 12A is displayed.

Since it is determined that the conveying speed V0 of the sheet is not normal, the conveying-speed determining unit 53 may instruct the conveyance control unit 57, which controls the conveyance of the sheet, to stop the conveyance of the sheet (ACT 105).

On the other hand, if it is determined that the conveying speed V0 of the sheet is normal (YES in ACT 104), the skew determining unit 52 determines the skew amount s (more specifically, the skew angle θ).

In ACT 106, the skew determining unit 52 calculates the skew amount s (the skew angle θ) from the ON time t2 of the conveyance sensor (1) 42 and the ON time t1 of the paper feed sensor 41 detected earlier. Specifically, the skew determining unit 52 calculates a difference between the ON time t2 of the conveyance sensor (1) 42 and the ON time t1 of the paper feed sensor 41 (T=t2−t1) (a passage period) and substitutes the calculated difference T in Formula 1 to calculate the skew amount s (the skew angle θ).

Standard conveying speed at normal time may be used as the conveying speed V0 of the sheet in Formula 1. Alternatively, actual conveying speed at the present point (only if it is determined in ACT 104 that the conveying speed is normal) may be used from the conveyance period $t_R$ calculated in ACT 103.

In ACT 107, the skew determining unit 52 determines whether the skew amount s (the skew angle θ) calculated in ACT 106 exceeds a predetermined limit value Smax1. The skew determination in ACT 107 is processing for determining occurrence of a relatively large amount of skew. If the skew amount s (the skew angle θ) exceeds the predetermined limit value Smax1, this means that the skew is so large that the skew correction is not properly performed by the registration rollers 34 and the skew is so large that a paper jam is caused by the skew.

If the skew amount s exceeds the predetermined limit value Smax1, in ACT 108, the tray-opening-closing detecting unit 50 determines a setting state of the tray flag.

If the tray flag is set to ON, it is highly likely that a cause of occurrence of skew is present in the paper feeding tray 7 in use that has been opened and then closed before the start of printing. Therefore, while the skew determining unit 52 instructs the conveyance control unit 57 to stop the conveyance of the sheet, the cause determining unit 55 instructs the display unit 56 to display a message for urging the user to check the inside of the paper feeding tray 7 in use (ACT 109).

Figure 12B:
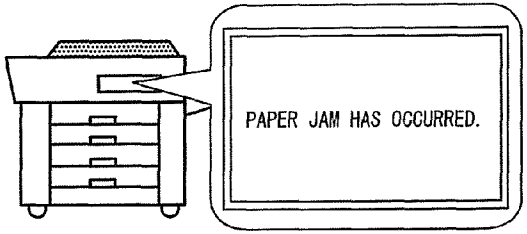

For example, when the paper feeding tray 7 in use is the paper feeding tray (2), as shown in FIG. 12B, the cause determining unit 55 instructs the display unit 56 to display a message such as "The sheet is conveyed in a skewed state. Please check whether sheets in the tray 2 and the guide are properly set."

With such message display, it is possible to prevent occurrence of a paper jam in advance by causing the user to check the paper feeding tray 7 estimated as a cause of occurrence of skew and removing the cause of the occurrence of the skew.

When skew occurs during printing performed by using the manual feed tray 8, in ACT 109, similar message display is performed. In this case, the cause determining unit 55 instructs the display unit 56 to display a message such as "The sheet is conveyed in a skewed state. Please check whether sheets are properly set in the manual feed tray."

Figure 12C:
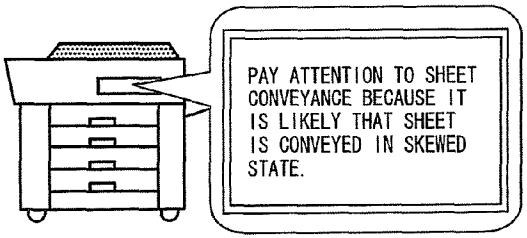

When the tray flag is off, skew occurs because of a cause other than the paper feeding tray 7. Therefore, in this case, as in the above case, the skew determining unit 52 instructs the conveyance control unit 57 to stop the conveyance of the sheet. Meanwhile, as shown in FIG. 12C, the cause determining unit 55 instructs the display unit 56 to display a message such as "The sheet is conveyed in a skewed state." With this message display, the user can correct skew as a cause of a paper jam by finding a cause of occurrence of skew other than the paper feeding tray 7 or calling a serviceperson.

On the other hand, if the skew amount s (the skew angle θ) is equal to or smaller than the predetermined limit value Smax1 (NO in ACT 107), this means that skew does not occur or, even if skew occurs, the skew is relatively small.

In ACT 111, the skew determining unit 52 determines presence or absence of smaller skew using a reference value Smax2 smaller than the limit value Smax1.

If small skew occurs (YES in ACT 111), presence or absence of a paper jam (ACT 112) is determined. Even if the skew is small in the conveying path 20 leading from the paper feeding tray 7 to the registration rollers 34, the skew may increase on the downstream side of the conveying path (e.g., near the transfer device 21 or the fixing device 17) to cause a paper jam. In such a case, even if the skew is small on the upstream side (the conveying path 20), the skew causes a paper jam.

Therefore, in ACT 113, the tray-opening-closing detecting unit 50 determines a state of the tray flag. If the tray flag is set to ON, the tray-opening-closing detecting unit 50 inform the user that an estimated cause of the occurrence of the skew is present in the paper feeding tray 7 opened and then closed previously (ACT 114). This is effective in terms of specifying a cause of occurrence of a paper jam.

Figure 12D:
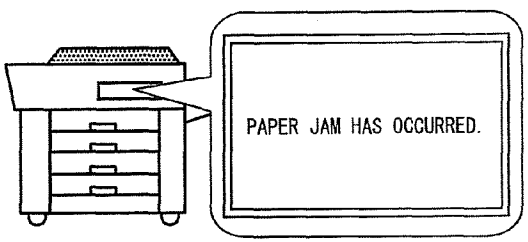

In ACT 114, the skew determining unit 52 instructs the conveyance control unit 57 to stop the conveyance of the sheet, and the cause determining unit 55 instructs the display unit 56 to display a message such as "Paper jam has occurred. Please check whether sheets and the guide in the tray (2) are properly set.", as shown in FIG. 12D.

Figure 12E:
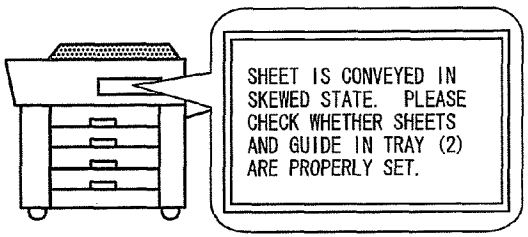

If the tray flag is OFF (NO in ACT 113) the cause determining unit 55 instructs the display unit 56 to simply display a message such as "Paper jam has occurred.", as shown in FIG. 12E.

Figure 12F:
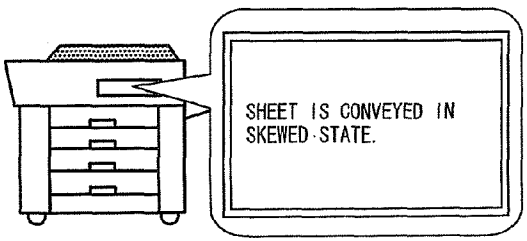

If small skew occurs but a paper jam does not occur (NO in ACT 112), the cause determining unit 55 instructs the display unit 56 to display a message such as "Pay attention to sheet conveyance because it is likely that the sheet is conveyed in a skewed state.", as shown in FIG. 12F (ACT 116), then the end of the printing is determined (ACT 117).

If even small skew does not occur (NO in ACT 111), the end of the printing is determined without performing anything (ACT 117).

When the printing ends (YES in ACT 117), if the opening and closing flag (n) is set to ON, the tray-opening-closing detecting unit 50 resets the opening and closing flag (n) to OFF and finishes the processing.

As explained above, with the image forming apparatus 1 and the method for controlling the same according to this embodiment, it is possible to detect occurrence of sheet skew without, for example, addition of a special sensor and even if conveying period changes because of abrasion or the like of the rollers, estimate a cause of the occurrence of the skew and inform the user of the cause, and prevent occurrence of a paper jam.

The present invention is not limited to the embodiments per se. It is possible to modify and embody the elements without departing from the spirit of the present invention at an implementation stage. It is possible to form various embodiments of the invention according to appropriate combinations of the plural elements disclosed in the embodiments. For example, several elements may be deleted from all the elements described in the embodiments. The elements described in different embodiments may be appropriately combined.

What is claimed is:

1. An image forming apparatus comprising:

a first sensor that is provided in a conveying path for a sheet and detects a first passage time of the sheet;

a second sensor that is provided at a position different from the position of the first sensor in both a transportation direction of the sheet and a direction perpendicular to the transportation direction, and detects a second passage time of the sheet;

a skew determining unit that calculates a skew amount of the sheet from a difference between the first passage time detected by the first sensor and the second passage time detected by the second sensor and determines occurrence of skew of the sheet on the basis of the skew amount;

a cause estimating unit that estimates, when the skew determining unit determines that the skew occurs, a cause of the occurrence of the skew;

a tray-opening-closing detecting unit that detects whether the paper feeding tray is opened and then closed; and a display unit displays, when the cause estimating unit estimates the cause of the occurrence of the skew, the estimated cause or an action based on the estimated cause together with indication of the occurrence of the skew, and wherein the cause estimating unit estimates, when skew of the sheet occurs after the paper feeding tray is opened and then closed, that the skew occurs because of the opened and then closed paper feeding tray, and the display unit performs display for urging a user to check the opened and then closed paper feeding tray.

2. An image forming apparatus comprising:

a first sensor that is provided in a conveying path for a sheet and detects a first passage time of the sheet;

a second sensor that is provided at a position different from the position of the first sensor in both a transportation direction of the sheet and a direction perpendicular to the transportation direction, and detects a second passage time of the sheet;

a skew determining unit that calculates a skew amount of the sheet from a difference between the first passage time detected by the first sensor and the second passage time detected by the second sensor and determines occurrence of skew of the sheet on the basis of the skew amount;

a cause estimating unit that estimates, when the skew determining unit determines that the skew occurs, a cause of the occurrence of the skew;

a manual-feed-tray detecting unit that detects whether a manual feed tray is in use; and the display unit displays, when the cause estimating unit estimates the cause of the occurrence of the skew, the estimated cause or an action based on the estimated cause together with indication of the occurrence of the skew wherein, the cause estimating unit estimates, when skew of the sheet occurs during the use of the manual feed tray, that the skew occurs because of the manual feed tray, and the display unit performs display for urging a user to be careful about a setting condition of a manually fed sheet.

3. The apparatus according to claim 1, wherein, when the skew amount is represented as $\theta$, a passage period of the sheet calculated from a difference between the first passage time t1 and the second passage time t2 is represented as T, a passage period in which the sheet passes between the first sensor and the second sensor when there is no skew is represented as T0, a distance in the direction orthogonal to the conveying direction between the first sensor and the second sensor is represented as L, and conveying speed of the sheet is represented as V, the skew determining unit calculates the skew amount $\theta$ according to $\tan\theta = ABS(T - T0)\cdot(V/L)$ and determines, when the skew amount $\theta$ is larger than a predetermined reference value, that skew of the sheet occurs.

4. The apparatus according to claim 1, further comprising a conveyance control unit that controls conveyance of the sheet, wherein the conveyance control unit stops the conveyance of the sheet when the skew amount determined by the skew determining unit is larger than a predetermined reference value.

5. The apparatus according to claim 1, further comprising:

a third sensor that is arranged in a position shifting from a straight line connecting the position of the first sensor and the position of the second sensor in the conveying path for the sheet and detects third passage time of the sheet; and a conveying-speed determining unit that determines conveying speed of the sheet according to the third passage time detected by the third sensor and at least one of the first passage time and the second passage time, wherein the skew determining unit determines occurrence of the skew when the conveying speed determined by the conveying-speed determining unit is within a predetermined range.

6. The apparatus according to claim 5, further comprising a conveyance control unit that controls conveyance of the sheet, wherein the conveyance control unit stops the conveyance of the sheet when the conveying speed determined by the conveying-speed determining unit is outside the predetermined range.

7. The apparatus according to claim 2, further comprising a paper-jam detecting unit that detects occurrence of a paper jam, wherein the display unit further displays, when the paper-jam detecting unit detects occurrence of a paper jam, indication to that effect.

8. A method for controlling an image forming apparatus comprising:

detecting a first passage time of a sheet with a first sensor provided in a conveying path for the sheet;

detecting a second passage time of the sheet with a second sensor provided in a position different from a position of the first sensor in both a conveying direction of the sheet and a direction orthogonal to the conveying direction;

determining occurrence of skew of the sheet from a difference between the first passage time detected by the first sensor and the second passage time detected by the second sensor;

estimating, when it is determined that the skew occurs, a cause of the occurrence of the skew;

displaying, when the cause of the occurrence of the skew is estimated in the estimating, the estimated cause or an action based on the estimated cause together with indication of the occurrence of the skew; and detecting whether a paper feeding tray is opened and then closed, wherein, in the estimating a cause, when skew of the sheet occurs after the paper feeding tray is opened and then closed, it is estimate that the skew occurs because of the opened and then closed paper feeding tray, and in the displaying, display for urging a user to check the opened and then closed paper feeding tray is performed.

9. A method for controlling an image forming apparatus comprising:

detecting a first passage time of a sheet with a first sensor provided in a conveying path for the sheet;

detecting a second passage time of the sheet with a second sensor provided in a position different from a position of the first sensor in both a conveying direction of the sheet and a direction orthogonal to the conveying direction;

determining occurrence of skew of the sheet from a difference between the first passage time detected by the first sensor and the second passage time detected by the second sensor;

estimating, when it is determined that the skew occurs, a cause of the occurrence of the skew;

displaying, when the cause of the occurrence of the skew is estimated in the estimating, the estimated cause or an action based on the estimated cause together with indication of the occurrence of the skew; and detecting whether a manual feed tray is in use, wherein, in the estimating a cause, when skew of the sheet occurs during the use of the manual feed tray, it is estimated that the skew occurs because of the manual feed tray, and in the displaying, display for urging a user to be careful about a setting condition of a manually fed sheet is performed.

10. The method according to claim 8, wherein, in the determining occurrence of the skew, when a skew amount is represented as $\theta$, a passage period of the sheet calculated from a difference between the first passage time t1 and the second passage time t2 is represented as T, a passage period in which the sheet passes between the first sensor and the second sensor when there is no skew is represented as T0, a distance in the direction orthogonal to the conveying direction between the first sensor and the second sensor is represented as L, and conveying speed of the sheet is represented as V, the skew amount $\theta$ is calculated according to $\tan\theta = ABS(T - T0)\cdot(V/L)$ and, when the skew amount $\theta$ is larger than a predetermined reference value, it is determined that skew of the sheet occurs.

11. The method according to claim 8, further comprising controlling conveyance of the sheet, wherein in the controlling the conveyance, the conveyance of the sheet is stopped when the skew amount determined in the determining occurrence of the skew is larger than a predetermined reference value.

12. The method according to claim 8, further comprising:

detecting third passage time of the sheet with a third sensor that is arranged in a position shifting from a straight line connecting the position of the first sensor and the position of the second sensor in the conveying path for the sheet; and determining conveying speed of the sheet according to the third passage time detected by the third sensor and at least one of the first passage time and the second passage time, wherein in the determining occurrence of the skew, occurrence of the skew is determined when the conveying speed determined in the determining conveying speed is within a predetermined range.

13. The method according to claim 12, further comprising controlling conveyance of the sheet, wherein in the controlling conveyance, when the conveying speed determined in the determining conveying speed is outside the predetermined range, the conveyance of the sheet is stopped.

14. The method according to claim 9, further comprising detecting occurrence of a paper jam, wherein in the displaying, when occurrence of a paper jam is detected, it is further displayed to that effect.

* * * * *